United States Patent [19]

Ekman

[11] Patent Number: 4,587,401

[45] Date of Patent: May 6, 1986

[54] ELECTRIC WATER HEATING APPLIANCE

[76] Inventor: Heinz Ekman, Pippurn, 02400 Kirkkonummi, Finland

[21] Appl. No.: 713,573

[22] Filed: Mar. 18, 1985

[30] Foreign Application Priority Data

Mar. 27, 1984 [FI] Finland ..... 841224

[51] Int. Cl.[4] ..... H05B 3/82; F24H 1/20

[52] U.S. Cl. ..... 219/314; 126/362; 126/364; 219/316; 237/19

[58] Field of Search ..... 219/312, 314, 316; 237/19; 126/364, 365, 362

[56] References Cited

U.S. PATENT DOCUMENTS

| | | | |
|---|---|---|---|
| 745,712 | 12/1903 | Allen | 126/364 UX |
| 1,633,759 | 6/1927 | Breese | 126/364 UX |
| 1,685,642 | 9/1928 | McCormick | 219/314 |
| 1,886,135 | 11/1932 | Tannehill | 219/314 UX |
| 2,620,431 | 12/1952 | Shepheard | 126/364 X |
| 2,698,739 | 1/1955 | Haugen | 237/19 X |
| 4,514,617 | 4/1985 | Amit | 219/314 |

FOREIGN PATENT DOCUMENTS

| | | | |
|---|---|---|---|
| 2142625 | 3/1972 | Fed. Rep. of Germany | 219/314 |
| 218590 | 7/1924 | United Kingdom | 126/365 |
| 341482 | 1/1931 | United Kingdom | 219/312 |

*Primary Examiner*—A. Bartis

*Attorney, Agent, or Firm*—Browdy and Neimark

[57] ABSTRACT

A heating appliance operable with a single heat source to heat both circulating water and water for domestic use includes an upright cylindrical reservoir containing water for household use and having an inlet at its lower end and an outlet at its upper end. A closed cylindrical tank of smaller diameter extends vertically concentrically through the reservoir and contains an electric immersion heating element for heating circulating water flowing through the tank from a lower inlet to an upper outlet. An elongated cylindrical tube in the reservoir extends concentrically about the tank in closely spaced relationship thereto and has a closed bottom end secured about a lower portion of the tank and an open upper end spaced from the upper end of the reservoir. The tube has circumferential openings disposed adjacent its bottom end for admitting cooler water from the reservoir into the space between the tube and tank for rapid heating of the water for household use by the flowing heated water circulating through the tank.

1 Claim, 3 Drawing Figures

ELECTRIC WATER HEATING APPLIANCE

The present invention concerns a heating appliance consisting of a reservoir containing liquid, such as water, which is heatable with the aid of a heat source, such as an electric resistance.

The drawback of heating appliances of this kind known in the art, such as water heaters, boilers, etc., is that the water reservoir has been dimensioned to be large with the objective that the warmed household water should positively suffice for the needs even of several persons, such as their washing and showering in succession. The object of the present invention is to eliminate the drawback and to provide a new type of heating appliance in which the water reservoir has been dimensioned to be as small as possible. The heating appliance of the invention is characterized in that around the heat source installed in upright position there is an elongated tube open at its top as well as its bottom end and constituting a small, rapidly heating liquid volume separate from the reservoir, whence the liquid that is warming up rises into the upper part of the reservoir. With the aid of the invention, hot water is continuously supplied into the upper part of the heating appliance, because the water volume around the heat source is minimal and is very rapidly heated, the water ascends into the upper part of the heating appliance and can be withdrawn for household water. Hereby there is no necessity to heat any large water quantities: the water is heated accordingly as it is being consumed.

An advantageous embodiment of the invention is characterized in that the heat source is located in a separate tubular liquid volume closed off from the reservoir, such as a circulating water heating volume of the heating appliance, around which the tube is located. Therefore the heating appliance operates, with one and the same heat source, both as circulating water heating appliance and as household water heating appliance.

Another embodiment of the invention is characterized in that the heat source consists of the flue gas exhaust duct of an oil burner, around which the tube is located. This is a so-called oil-operated boiler in which according to the design taught by the present invention the capacity of the household water reservoir can be dimensioned to be exceedingly small.

Figure 1:
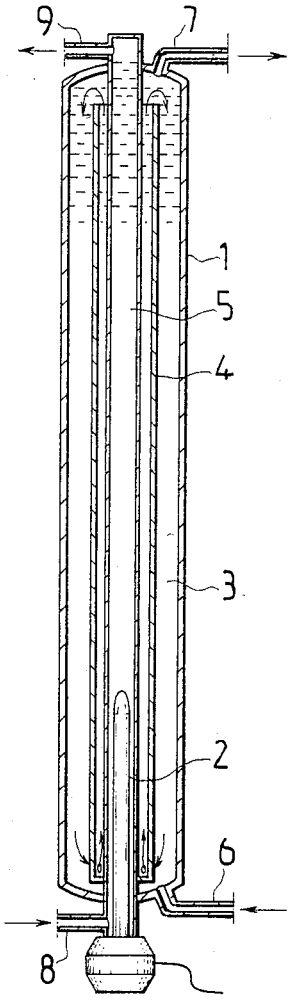

The invention is described in the following with the aid of an example, referring to the attached drawing, wherein FIG. 1 presents a heating appliance comprising both a water boiler for household water and a circulating water heating section.

Figure 2:
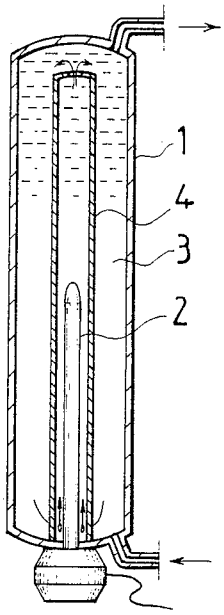

FIG. 2 presents a simple water boiler.

Figure 3:
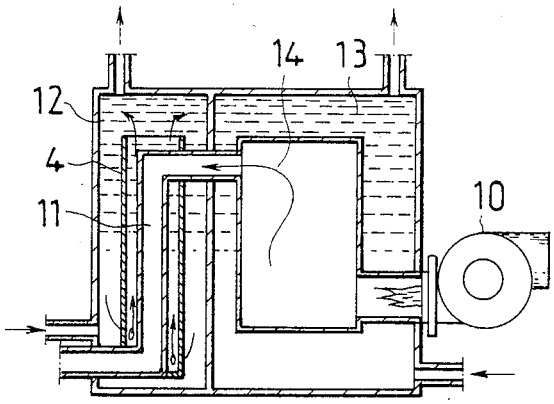

FIG. 3 presents a boiler provided with an oil burner.

In FIGS. 1 and 2, the heating appliance consists of an elongated upright reservoir 1 containing household water 3 that is heatable with an electric resistance 2. Around the electric resistance 2 there is an elongated tube 4, open at its top as well as its bottom end and which constitutes a small, rapidly heating liquid volume separate from the reservoir 1, wherein the liquid being warmed up rises into the upper part of the reservoir 1, as indicated by arrows. In FIG. 1, the electric resistance is located in a separate tubular heating volume 5 for the circulating water of the heating appliance, closed off from the reservoir, around which the tube 4 is located. In this instance the electric resistance is in no direct connection with the household water; instead, the circulating water heating volume 5 very rapidly heats the water quantity present between the heating volume 5 and the tube 4, this water quantity rising to the upper part of the heating appliance. In the lower part of the reservoir 1 has been provided a cold water intake connector 6, and there is a connector 7 for the warm household water in the top part of the reservoir. The circulating water of the heating appliance has similarly been connected with the circulating water heating volume by connectors 8 and 9.

In FIG. 3, the heat source consists of an oil burner, and the flue gas exhaust duct 11 serves as heat source for the household water 12, the tube 4 being located therearound. The circulating water 13 becomes heated, in this case, around the firebox 14.

It is obvious to a person skilled in the art that the invention is not confined to the examples presented in the foregoing and that it may instead vary within the scope of the claims stated below.

I claim:

1. A heating appliance for heating a reservoir of water for household use, comprising:

a first cylindrical tank having a vertically disposed longitudinal axis, said first tank containing said reservoir of water for household use and including inlet means at a lower end thereof and outlet means at an upper end thereof;

a second cylindrical tank having a diameter substantially smaller than the diameter of said first tank and containing a second reservoir of water, said second tank having a vertically extending longitudinal axis and extending concentrically through said first tank, said second tank having outlet means at its upper end and inlet means at its lower end for circulating the water through said second reservoir, the water in said second reservoir being maintained entirely separate from the water in said first tank reservoir by the wall of said second tank;

heating means, disposed within the lower portion of said second tank and being immersed in said second reservoir, for heating the water in said second tank; and an elongated tube extending concentrically about said second tank from a lower portion of said first tank to an upper portion of said first tank, said tube having a closed bottom end secured about a lower portion of said second tank and an open top end, said tube and said second tank defining therebetween a third reservoir of significantly smaller diameter than the diameter of said first tank, whereby the water in said third reservoir is quickly heated by the heated water in said second tank, said tube having circumferential openings disposed adjacent said bottom end for admitting cooler water from said first tank whereby said admitted cooler water may be heated in said third reservoir.

* * * * *